US011851988B2

(12) United States Patent
Newton et al.

(10) Patent No.: US 11,851,988 B2
(45) Date of Patent: Dec. 26, 2023

(54) WELL UNLOADING VALVE

(71) Applicant: Abu Dhabi National Oil Company, Abu Dhabi (AE)

(72) Inventors: Daniel Newton, Abu Dhabi (AE); Daniel Beaman, Abu Dhabi (AE); Campbell Mitchell, Abu Dhabi (AE)

(73) Assignee: Abu Dhabi National Oil Company, Abu Dhabi (AE)

( * ) Notice: Subject to any disclaimer, the term of this patent is extended or adjusted under 35 U.S.C. 154(b) by 245 days.

(21) Appl. No.: 17/603,313

(22) PCT Filed: Apr. 15, 2019

(86) PCT No.: PCT/IB2019/053076

§ 371 (c)(1),
(2) Date: Oct. 12, 2021

(87) PCT Pub. No.: WO2020/212726

PCT Pub. Date: Oct. 22, 2020

(65) Prior Publication Data

US 2022/0186587 A1 Jun. 16, 2022

(51) Int. Cl.
*E21B 34/14* (2006.01)
*E21B 34/06* (2006.01)
(Continued)

(52) U.S. Cl.
CPC ..... *E21B 34/14* (2013.01); *E21B 34/066* (2013.01); *E21B 34/08* (2013.01); *E21B 43/123* (2013.01); *E21B 2200/06* (2020.05)

(58) Field of Classification Search
CPC ..... E21B 34/14; E21B 34/06; E21B 34/08; E21B 2200/06; E21B 34/066; E21B 43/123
See application file for complete search history.

(56) References Cited

U.S. PATENT DOCUMENTS 6,138,754 A * 10/2000 Veneruso ..... F16K 31/04 417/63
7,467,665 B2 12/2008 Mackenzie
(Continued)

FOREIGN PATENT DOCUMENTS

CN 204371254 U 6/2015
CN 108316887 A 7/2018
(Continued)

OTHER PUBLICATIONS

First Chinese Office Action issued for corresponding Chinese Application No. 201980095417.1, dated Apr. 22, 2023.
(Continued)

*Primary Examiner* — Daniel P Stephenson
(74) *Attorney, Agent, or Firm* — Renner, Otto, Boisselle & Sklar, LLP

(57) ABSTRACT

A well unloading valve for a petrochemical well tubing comprising a flow passage connecting an annulus outside the tubing with the inside of the tubing; a lock-out sleeve for selectively closing the flow passage, wherein the lock-out sleeve can be moved from an open to a closed position by means of hydraulic pressure within the tubing; an electrically activated motor module for moving a seal, wherein the seal selectively opens a hydraulic connection from the inside of tubing to the lock-out sleeve for moving the lock-out sleeve hydraulically from the open to the closed position; and a check valve within the flow passage for allowing a flow from the annulus into the tubing and for blocking a flow from the tubing into the annulus. Further a method for unloading a petrochemical well tubing is claimed.

15 Claims, 1 Drawing Sheet

(51) Int. Cl.
*E21B 34/08* (2006.01)
*E21B 43/12* (2006.01)

(56) References Cited

U.S. PATENT DOCUMENTS

| | | | | |
|---|---|---|---|---|
| 9,869,153 | B2 | 1/2018 | Moreno et al. | |
| 2009/0194289 | A1 | 8/2009 | Clem | |
| 2009/0206290 | A1 | 8/2009 | Wygnanski | |
| 2011/0203805 | A1* | 8/2011 | Kritzler | E21B 34/08 166/373 |
| 2012/0145397 | A1 | 6/2012 | Schultz et al. | |
| 2012/0152552 | A1 | 6/2012 | Mitchell et al. | |
| 2014/0338922 | A1 | 11/2014 | Lopez et al. | |
| 2020/0032627 | A1* | 1/2020 | Salihbegovic | E21B 43/123 |
| 2022/0186587 | A1* | 6/2022 | Newton | E21B 34/066 |

FOREIGN PATENT DOCUMENTS

| | | | |
|---|---|---|---|
| GB | 944426 | A | 12/1963 |
| GB | 2427422 | A | 12/2006 |
| WO | 2000029714 | A1 | 5/2000 |

OTHER PUBLICATIONS

International Search Report dated Jul. 30, 2019, for priority International Patent Application No. PCT/IB2019/053076.
Written Opinion dated Jul. 30, 2019, for priority International Patent Application No. PCT/IB2019/053076.
Examination and Search Report issued for counterpart UAE Patent Application No. P6001882/2021, dated Aug. 22, 2023.

* cited by examiner

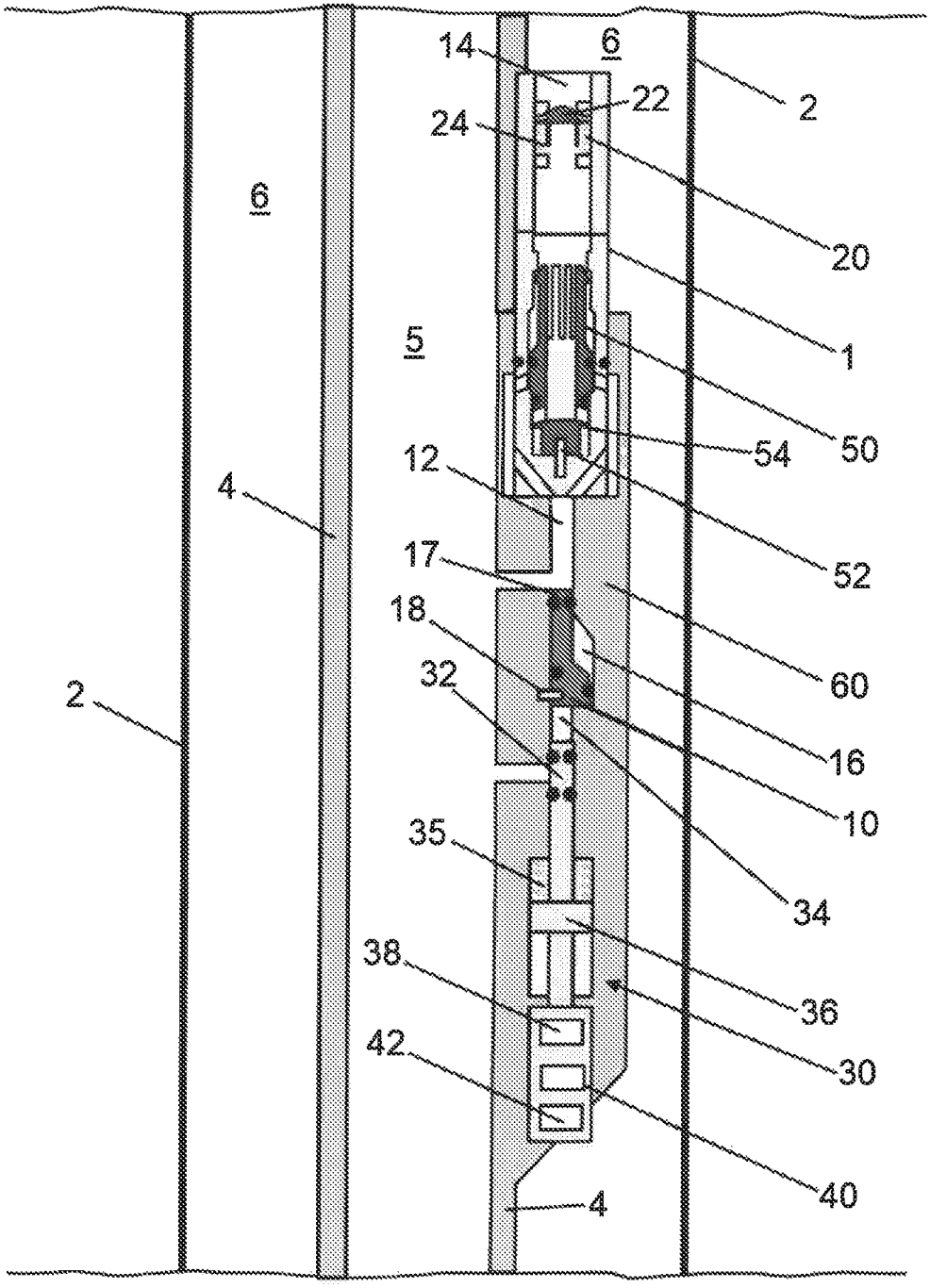
14
6
22
2
24
6
20
1
5
50
54
12
4
52
17
60
18
32
16
2
10
35
34
38
36
30
42
40
4

WELL UNLOADING VALVE

This application is a national phase of International Application No. PCT/162019/053076 filed 15 Apr. 2019, the entire disclosure of which is hereby incorporated by reference.

1. FIELD OF THE INVENTION

The invention relates to a well unloading valve for a petrochemical well tubing and to a method of operating a well unloading valve.

2. PRIOR ART

Well unloading valves are used in petrochemical production to assist the production of liquids, particularly oil, from a well. The gas lift process involves injecting natural gas through the annulus between tubing and casing in a producing well. This gas is fed through paths in the tubing into the interior of the tubing. The injected gas creates bubbles in the produced fluid contained in the tubing making the fluid less dense. This makes it possible for the formation pressure to lift the column of fluid in the tubing an increases the amount of fluid produced from the wellbore.

For performing well construction integrity tests and unload the wells without incurring critical path rig time commonly Remote Actuated Barrier Devices (RABD) in conjunction with a tubing shear gas lift valve (TSGLV) that auto converts from barriers to gas lift valves via application of tubing pressure was used. However, on non-gas lifted wells production wells or injection wells with temporary initial production/unloading leaving a live gas lift valve in situ has multiple related issues being:

- Unable to pressure test annulus for well integrity confirmation in future.
- Potential leak path.
- Potential high cost of deploying sacrificial Gas Lift Mandrel/Gas Lift Valve, especially in injector wells requiring high CRA material such as nickel alloy.
- VO (Gas 'bubble tight' testing)/gas differential pressure rating requirement from tubing to annulus if well utilized for gas injection.

Some suppliers have attempted to address such issues by developing either electronically actuated, hydraulically powered multi cycle circulation valves (e.g. Halliburton's e-red HS valve) or full hydraulic actuated circulation valves (e.g. Baker Hughes' CMP Defender Sliding Sleeve and HP Defender Sleeve).

Exemplarily, the prior art document U.S. Pat. No. 9,869,153 discloses a remotely controllable valve, responsive to at least one downhole trigger condition, such as downhole pressure or temperature, wherein the remotely controllable valve may function as at least one of a fluid-loss control valve in a completion string assembly or a circulation valve about a completion string assembly. The valve comprises at least one of a hydraulic pump and electric motor coupled to the controller, and a sleeve axially movable by one of the hydraulic pump and the electric motor.

Further, prior art document U.S. Pat. No. 7,467,665 discloses a system and a method for operating a circulation valve. The valve is autonomous and is actuated between an open to a closed position by a power screw. The actuation of the power screw is done in response to particular conditions, such as the passing of a predetermined amount of time, or wellbore conditions, such as pressure or temperature.

However, such prior art valves are rather complex in construction and may be prone to the so called "U-tubing effect" when activated, which means that liquid from the tubing is passing through the valve and entering the annulus.

Therefore, it is an object of the present invention to overcome the above mentioned drawbacks of the prior art.

3. SUMMARY OF THE INVENTION

The above mentioned problems are solved by a well unloading valve and a method of operating a well unloading valve as described in the present disclosure.

Preferably the above mentioned object is solved by a well unloading valve for a petrochemical well tubing comprising a flow passage connecting an annulus outside the tubing with the inside of the tubing; a lock-out sleeve for selectively closing the flow passage, wherein the lock-out sleeve can be moved from an open to a closed position by means of hydraulic pressure within the tubing; an electrically activated motor module for moving a seal, wherein the seal selectively opens a hydraulic connection from the inside of tubing to the lock-out sleeve, for moving the lock-out sleeve hydraulically from the open to the closed position; and a check valve within the flow passage, for allowing a flow from the annulus into the tubing, and for blocking a flow from the tubing into the annulus.

The flow passage allows in open state that gas provided in the annulus is entering the tubing and can be used for gas-lifting purposes.

The lock-out sleeve serves for selectively closing the flow passes if necessary. It is hydraulically moved by the pressure within the tubing, which makes actuation very reliable as the closing forces can be very high and depended from the tubing pressure. The hydraulic actuation of the lock-out sleeve is initiated by the electrically activated motor module, such that actuation can take place electronically controlled. This allows actuation when any predetermined conditions are met.

The check valve prevents the U-tubing effect as it does not allow a backflow of fluid from the tubing into the annulus.

Preferably, the check valve is arranged at the annulus end of the flow passage. Thus, the tubing pressure within the flow passage can be used for actuation of further elements of the well unloading valve.

Preferably, the well unloading valve further comprises a bi-directional sealing device for closing and opening the flow passage, wherein the sealing device is initially arranged in a closed position, in which the flow passage is closed, and wherein the sealing device is configured to move into an open position, in which the flow passage is open, due to an actuation by a specific pressure in the tubing. The bi-directional sealing device is initially closed during first installation of the well tubing and securely closes the flow passage. This enables pressure tests prior to use of the tubing for production. The sealing device can easily be opened by a specific pressure applied to the tubing.

Preferably, the sealing device comprises a shearing device which holds the sealing device in its closed position and which shears-off during actuation of the sealing device. Such shearing device is very reliable in holding the sealing device in closed position until it is desired to open the sealing device. As the shearing device can only be sheared-off once the sealing device remains open during the further lifetime of the well unloading valve.

Preferably, the sealing device further comprises a spring that biases the sealing device to the open position. The spring supports the tubing pressure for opening the sealing device.

Preferably, the motor module comprises a spring for moving the seal from closed to open position. The spring of the motor module provides the actuation energy for moving the seal from closed to open position. The spring can store a high amount of potential energy and thus is a very reliable and robust means for actuating the seal. The spring does not require any maintenance and stores the energy much longer than any battery used in the prior art. This improves reliability of the functioning of well unloading valve even, when used for a long period time.

Preferably, the spring is a helical spring acting upon a piston which is connected to the seal. Thus, a linear movement of the seal is given.

Preferably, the motor module further comprises an electrically driven retainer, wherein the retainer holds the piston such that the motor module is in closed position of the seal, and wherein the retainer releases the piston such that the motor module moves to the open position of the seal. The retainer releases the high potential energy of the spring but does itself only require little electrical energy to do so. This further improves reliability of the functioning of the well unloading valve.

Preferably, the motor module further comprises an electronics module, which activates the retainer if one or more of the following conditions is achieved: (a) the temperature of the fluid within the tubing reaches a predetermined temperature; and/or (b) predetermined time period has lapsed. By such conditions the closing of the flow path of the well unloading valve can be exactly determined and controlled.

Preferably, the motor module further comprises a battery as electric power supply of the motor module.

The above mentioned objects are also achieved by a method of operating a well unloading valve as described above comprising the following steps:

a. electrically activating the motor module;
b. moving the seal to an open position;
c. opening the hydraulic connection from the inside of the tubing to the lock-out sleeve;
d. applying hydraulic pressure from the inside of the tubing to the lock-out sleeve; and
e. moving the lock-out sleeve from the open to the closed position, for closing the flow passage.

Preferably, the step of electrically activating the motor module comprises the following sub-steps:

a. electrically driving a retainer of the motor module;
b. releasing a piston by the retainer, wherein the seal is connected to the piston; and
c. linearly moving the piston by a spring.

Preferably, the method of operating a well unloading valve further comprises the following steps:

a. sensing the temperature of a fluid within the tubing; and/or
b. determining if a predetermined time period has lapsed; and then
c. starting the electric activation of the motor module.

Preferably, the method of operating a well unloading valve further comprises the following steps performed prior to the other steps:

a. applying of predetermined pressure to the tubing;
b. shearing a shearing device of a sealing device; and
c. moving the sealing device to an open position, for allowing a fluid flow through the flow passage.

Preferably, the method of operating a well unloading valve further comprises the following step:

a. allowing by the check valve a flow of fluid through the flow passage from the annulus into the tubing; and
b. blocking by the check valve a flow of fluid through the flow passage from the tubing into the annulus.

4. SHORT DESCRIPTION OF THE DRAWINGS

In the following, preferred embodiments of the invention are disclosed by reference to the accompanying FIGURE, in which shows:

FIG. 1 a partial sectional side view of an embodiment of a well unloading valve introduced into a well.

5. DETAILED DESCRIPTION OF PREFERRED EMBODIMENTS

In the following, preferred embodiments of the invention are described in detail with respect to the FIGURE.

FIG. 1 shows a partial sectional side view of an embodiment of a well unloading valve 1 introduced into a petrochemical well having a casing 2. The well unloading valve 1 is arranged vertically along the outer side of a tubing 4 inserted into the casing 2. A plurality of well unloading valves 1 can be provided along the length of the tubing 4 within the well. Preferably, the well unloading valves 1 are arranged along predetermined distances of the tubing 4 and serve for selectively introducing a gas flow from the annulus 6 between the tubing 4 and the casing 2 into the liquid within the tubing 4.

The well unloading valve 1 comprises as main components a flow passage 12 for the introduction of the gas, a lock-out sleeve 10, an electrically activated motor module 30 and a check valve 20. Further, the well unloading valve 1 may comprise a bi-direction sealing device 50 for initially closing the well unloading valve during installation of the tubing and for the pressure tests.

The flow passage 12 is a channel of predetermined cross section introduced into a body 60 of the well unloading valve 1. It connects the annulus 6 outside the tubing 4 with the inside 5 of the tubing 4 and allows in open state a flow of gas introduced into the annulus 6 to enter the inside 5 of the tubing 4. There, the gas can mix with the elevating liquid, e.g. crude oil and can support the lifting process.

The lock-out sleeve 10 serves for closing or blocking the flow passage 12 if desired. The flow passage 12 can be blocked at the end of production. In FIG. 1 the lock-out sleeve 10 is shown in the open state, where the flow passage 12 is open. The lock-out sleeve 10 can be moved to the closed state with hydraulic pressure from the inside 5 of the tubing 4. To do so a hydraulic connection 34 is opened which subjects the underside of the lock-out sleeve 10 to the pressure within the tubing 4. This pressure moves the lock-out sleeve 10 upwards into the space 16 and an upper portion 17 of the lock-out sleeve closes the flow passage 12. For securing the lock-out sleeve 10 in open position prior to the application of actuation pressure a shear pin 18 is provided which locks the lock-out sleeve 10 with the body 60.

The electrically actuated motor module 30 serves for activating the lock-out sleeve 10. The motor module 30 comprises a piston 36 that can axially move and which has a seal 32 at the upper end. The seal 32 selectively opens the hydraulic connection 34 from the inside 5 of tubing 4 to the lock-out sleeve 10 for moving the lock-out sleeve 10 hydraulically from the open to the closed position. The piston 36 is moved by the pressure of a helical spring 35. To do so the piston 36 is released by a an electrically driven retainer 38. Initially, the retainer 38 holds the piston 36 such that the motor module 30 and the seal 32 is in closed position. When the retainer 38 receives an electric activation signal, it releases the piston 36 such that the motor module 30 moves to the open position of the seal 32.

The activation signal for the retainer 38 is provided by an electronics module 40 that is powered by a battery 42. The electronics module 40 may comprise sensors for sensing the pressure and temperature of the liquids within the tubing 4 or within the annulus 6. Further the electronics module 40 comprises a clock for counting the time. The electronics module 40 may for example activate the retainer 30 if the temperature of the fluid within the tubing 4 reaches a predetermined temperature and/or if a predetermined time period has lapsed or combinations thereof.

The check valve 20 comprises a one-way seal 22 that biased by a spring 24 against a sealing socket. The check valve 20 is arranged at the annulus end 14 of the flow path 12 and prevents any liquid or pressure from entering from the interior 5 of the tubing 4 into the annulus 6. However, the check-valve 20 allows a flow of fluid or gas from the annulus 6 through the flow path 12 into the interior 5 of the tubing 4.

The bi-directional sealing device 50 serves for blocking or closing the flow path 12 during RIH (run into hole, tubing installation) and the initial pressure testing phases of the tubing 5. Thus, the fluid flow through the flow path 12, a fluid connection 13 between the sealing device 50 and the check valve 20, and the annulus end 14 can be controlled by the bi-directional sealing device 50. The sealing device 50 is configured to move into an open position, in which the flow passage 12 is open, due to an actuation by a specific pressure in the tubing 4. This allows to open the bi-directional sealing device 50 as desired after installation of the tubing 4. The sealing device 50 further comprises a shearing device 52 which holds the sealing device 50 in its closed position and which shears-off during actuation of the sealing device 50 with a sufficiently high predetermined tubing pressure. Further, the sealing device 50 further comprises a spring 54 that biases the sealing device 50 to the open position what allows to select the predetermined opening pressure for the sealing device 50 at a desired amount.

LIST OF REFERENCE SIGNS

1 well unloading valve
2 casing
4 tubing
5 inside of tubing
6 annulus
10 lock-out sleeve
12 flow passage
13 fluid connection
14 annulus end of flow passage
16 space for lock-out sleeve
17 upper portion of lock-lock out sleeve
18 shear pin
20 check valve
22 one-way seal
24 spring
30 electrically activated motor module
32 seal
34 hydraulic connection
35 helical spring
36 piston
38 electrically driven retainer
40 electronics module
42 battery
50 bi-directional sealing device
52 shearing device
54 spring
60 body

The invention claimed is:

1. A well unloading valve for a petrochemical well tubing comprising:

a flow passage connecting an annulus outside the tubing with the inside of the tubing;

a lock-out sleeve for selectively closing the flow passage, wherein the lock-out sleeve can be moved from an open to a closed position by means of hydraulic pressure within the tubing;

an electrically activated motor module for moving a seal, wherein the seal selectively opens a hydraulic connection from the inside of tubing to the lock-out sleeve for moving the lock-out sleeve hydraulically from the open to the closed position; and a check valve within the flow passage for allowing a flow from the annulus into the tubing and for blocking a flow from the tubing into the annulus.

2. The well unloading valve according to claim 1, wherein the check valve is arranged at the annulus end of the flow passage.

3. The well unloading valve according to claim 1, further comprising a bi-directional sealing device for closing and opening the flow passage, wherein the sealing device is initially arranged in a closed position, in which the flow passage is closed, and wherein the sealing device is configured to move into an open position, in which the flow passage is open, due to an actuation by a specific pressure in the tubing.

4. The well unloading valve according to claim 3, wherein the sealing device comprises a shearing device which holds the sealing device in its closed position and which shears-off during actuation of the sealing device.

5. The well unloading valve according to claim 3, wherein the sealing device further comprises a spring that biases the sealing device to the open position.

6. The well unloading valve according to claim 1, wherein the motor module comprises a spring for moving the seal from closed to open position.

7. The well unloading valve according to claim 6, wherein the spring is a helical spring acting upon a piston which is connected to the seal.

8. The well unloading valve according to claim 6, wherein the motor module further comprises an electrically driven retainer, wherein the retainer holds the piston such that the motor module is in closed position of the seal, and wherein the retainer releases the piston such that the motor module moves to the open position of the seal.

9. The well unloading valve according to claim 1, wherein the motor module further comprises an electronics module which activates the retainer if one or more of the following conditions is achieved:

the temperature of the fluid within the tubing reaches a predetermined temperature; and/or a predetermined time period has lapsed.

10. The well unloading valve according to claim 1, wherein the motor module further comprises a battery as electric power supply of the motor module.

11. A method of operating a well unloading valve according to claim 1 comprising the following steps:

electrically activating the motor module;

moving the seal to an open position;

opening the hydraulic connection from the inside of the tubing to the lock-out sleeve;

applying hydraulic pressure from the inside of the tubing to the lock-out sleeve; and moving the lock-out sleeve from the open to the closed position, for closing the flow passage.

12. The method of operating a well unloading valve according to claim 11, wherein the step of electrically activating the motor module comprises the following sub-steps:

electrically driving a retainer of the motor module;

releasing a piston by the retainers, wherein the seal is connected to the piston; and linearly moving the piston by a spring.

13. The method of operating a well unloading valve according to claim 11, further comprising the following steps:

sensing the temperature of a fluid within the tubing; and/or determining if a predetermined time period has lapsed; and then starting the electric activation the motor module.

14. The method of operating a well unloading valve according to claim 11 further comprising the following steps performed prior to the other steps:

applying of predetermined pressure to the tubing;

shearing a shearing device of a sealing device; and moving the sealing device to an open position, for allowing a fluid flow through the flow passage.

15. The method of operating a well unloading valve according to claim 14 further comprising the following steps:

allowing by the check valve a flow of fluid through the flow passage from the annulus into the tubing; and blocking by the check valve a flow of fluid through the flow passage from the tubing into the annulus.

* * * * *